US006729076B1

(12) United States Patent
Gale

(10) Patent No.: US 6,729,076 B1
(45) Date of Patent: May 4, 2004

(54) SUPPORT STRUCTURE FOR AN AWNING OR THE LIKE

(76) Inventor: Kenneth Ronald Gale, 1655 Ocean Dr., Lake Cathie, New South Wales 2445 (AU)

( * ) Notice: Subject to any disclaimer, the term of this patent is extended or adjusted under 35 U.S.C. 154(b) by 0 days.

(21) Appl. No.: 09/868,421

(22) PCT Filed: Dec. 15, 1999

(86) PCT No.: PCT/AU99/01109

§ 371 (c)(1),
(2), (4) Date: Oct. 9, 2001

(87) PCT Pub. No.: WO00/36246

PCT Pub. Date: Jun. 22, 2000

(30) Foreign Application Priority Data

Dec. 17, 1998 (AU) ..... PP 7759

(51) Int. Cl.[7] ..... E04F 10/10; E04F 10/00

(52) U.S. Cl. ..... 52/74; 52/29; 135/90; 135/98; 135/135; 160/53; 160/81

(58) Field of Search ..... 52/29, 65, 73, 52/74, 75; 135/117, 90, 98, 135; 160/53, 56, 65, 78, 81, 84.07, 134

(56) References Cited

U.S. PATENT DOCUMENTS

| | | | | | |
|---|---|---|---|---|---|
| 363,155 | A | * | 5/1887 | Mason | 160/56 |
| 462,324 | A | * | 11/1891 | Newton | 160/53 |
| 2,699,823 | A | * | 1/1955 | Zveibil | 160/62 |
| 3,075,257 | A | * | 1/1963 | Rosen | 52/82 |
| 3,134,426 | A | * | 5/1964 | Cherubin | 160/81 |
| 3,454,022 | A | * | 7/1969 | Ferguson | 135/15.1 |
| 6,267,130 | B1 | * | 7/2001 | Konda | 135/133 |
| 6,273,115 | B1 | * | 8/2001 | Guggisberg | 135/135 |

FOREIGN PATENT DOCUMENTS

| | | | | |
|---|---|---|---|---|
| AU | 239834 | * | 7/1962 | 52/74 |
| AU | 9151682 | | 6/1983 | |
| BE | 0396458 | | 5/1953 | |
| DE | 0433930 | | 11/1926 | |
| FR | 1365403 | | 5/1964 | |
| GB | 267995 | * | 3/1927 | 52/75 |
| GB | 1488351 | | 10/1977 | |
| GB | 2259927 | | 3/1993 | |
| NL | 0079156 | | 8/1955 | |
| WO | WO 9807937 | | 2/1998 | |
| WO | WO 9838400 | | 9/1998 | |

* cited by examiner

*Primary Examiner*—Brian E. Glessner
(74) *Attorney, Agent, or Firm*—Mark R. Wisner

(57) ABSTRACT

A support for an awning (10) comprises a plurality of inner members (28), each being pivotally connected to adjacent ones of the inner members (28). Support members (16), the are strengthened by braces (36) extend outwardly from the inner members (28). An awning material, such as shade cloth or canvas, is supported by the support members (16). The support is fixed to a wall (12) or a pole. The support can move between a retracted position in which the support members (16) lie adjacent to each other and an extend position in which distal ends of the support members are spaced from each other. The awning is compact when in the retracted position and aesthetically pleasing.

20 Claims, 4 Drawing Sheets

SUPPORT STRUCTURE FOR AN AWNING OR THE LIKE

FIELD OF THE INVENTION

The present invention relates to a support apparatus. The support apparatus is particularly suitable for supporting an awning or the like. The present invention also relates to an awning.

BACKGROUND OF THE INVENTION

The use of awnings to provide shade around building structures is common place, Awnings, however, take up considerable space and it is not always desirable for shade to be provided such as in cooler seasons or where the permanent provision of shade may inhibit the growth of grass.

Indeed, it is not always practical for a conventional awning to be provided where space is limited and in those circumstances where the provision of a fixed conventional awning would not be suitable as it would look out of place.

Clothes lines with retractable tendons to which clothes are pegged in use to facilitate the drying of the clothes are also well known. Clothes lines of this type are also generally used in situations were only limited space is available.

SUMMARY OF THE INVENTION

In a first aspect, the present invention provides a support apparatus for supporting an awning or the like comprising a plurality of inner members, said plurality of inner members including a plurality of generally vertically extending members, each inner member being pivotally connected to an adjacent inner member, a plurality of outwardly extending support members extending outwardly from the generally vertically extending members and a plurality of braces, each brace extending from a generally vertically extending member to an outwardly extending support member associated with the generally vertically extending support member.

In a further aspect, the present invention provides a support apparatus for supporting an awning or the like comprising a first set of inner members, each of the inner members being pivotally connected to adjacent inner members of the first set, a second set of inner members, each of the inner members of the second set being pivotally connected to adjacent inner members of the second set, outwardly extending support members extending outwardly from the inner members of the first set, outwardly extending support members extending outwardly from the inner members of the second set, each set of inner members being connected to a stationary structure, each set of inner members being movable from an open position in which the plurality of inner members are in generally arcuate alignment to a retracted position in which the inner members are in generally linear alignment, wherein in the open position each set of inner members extends such that the end inner member of one set that is located away from the fixed end inner member of that set becomes positioned and adjacent to or in abutment with the corresponding inner member of the other set such that the respective support members associated with the end inner members of each set are in abutment with each other or are positioned adjacent to each other, the apparatus further comprising releasable fixing means to join the respective end inner members or end support members of each set to each other to thereby hold the support apparatus in the open position.

Preferably, the support apparatus further comprises a plurality of outwardly extending support members. Preferably, each of the inner members has a support member extending outwardly therefrom. The support members may be integrally formed with the inner members. Alternatively, the support members may be connected to the inner members. Preferably, the support members are pivotally connected to the inner members.

Each inner member is preferably pivotally connected to an immediately adjacent inner member. If an inner member has immediately adjacent inner members positioned on either side thereof, it is pivotally connected to both of the immediately adjacent inner members.

The inner members are preferably pivotally connected to other inner members by use of pivot pins that pass through aligned holes in the immediately adjacent inner members.

When the apparatus of the present invention is in the retracted position, the generally outwardly extending support members lie close to or adjacent others of the support members. When moved to the open position, the support members fan out such that the distal ends of the support members are spaced from each other. In the open position, the support members therefore extend out over a much larger area than when in the retracted position.

In a second aspect, the present invention provides a support apparatus for an awning or the like comprising a plurality of inner members being pivotally connected to at least one other of the inner members and a plurality of support members extending generally outwardly from the inner members, said support apparatus being able to be moved from a retracted position in which the support members lie close to or adjacent other of the support members to an open position in which distal ends of the support members are spaced from each other.

In a third aspect, the present invention provides apparatus comprising at least one support structure incorporating a hub and a number of support members that extend from and are secured at one end to the hub. The hub has a plurality of inner members connected together in a side by side relationship.

Immediately adjacent ones of the inner members are pivotable relative to one another about an axis of rotation respectively, thereby enabling the support members to be swung about a common axis in a first direction to be spaced apart from each other and in an opposite second direction to be nested together. Preferably, the axes of rotation and the common axis are substantially parallel.

Generally, the hub will further comprise one or more pivot pins located between the immediately adjacent ones of the inner members and about which the inner members are pivotable to enable the support members to be spaced apart or nested together.

As the inner members of the support structure are connected together, the apparatus has a relatively high degree of stability in use. Such an arrangement also ensures controlled movement of the support members as they are swung about the hub leading to enhanced operation and handling of the apparatus.

Moreover, the apparatus is able to be retracted to a relatively compact state for use in those areas where space is limited or where it is not desirable to have the apparatus permanently extended.

The apparatus may be an awning in which case the support members will generally support a foldable cover for providing shade when the support members are distanced apart from each other. Alternatively, the apparatus may be, for instance, a clothes line. In this instance, the support members will typically support a plurality of tendons to which clothes can be pegged in use and which extend from support member to support member in the same manner as the tendons of conventionally known clothes lines.

In all aspects of the present invention, it is preferred that the support members lie in essentially the same plane.

In some embodiments of the present invention, each inner member comprises a generally vertically extending member pivotally connected to an immediately adjacent inner member such that they, can pivot relative to each other about a vertical axis. A support member extends from an upper part of each inner member and the support member may be braced by a brace member extending from a lower part of the inner member and being connected to the support member. The support apparatus may be fixed to a stationary structure, such as a wall or a pole, by connecting an end one of the plurality of inner members to the stationary structure.

The support apparatus may comprise two sets of inner members, each set of inner members being connected to the stationary structure. In the open position, each set of inner members extends such that the end inner member of each set that is located away from the fixed end inner members of each set become positioned adjacent to or in abutment with the corresponding end inner member of the other set. This results in the respective support members associated with the end inner members of each set coming into abutment with each other or being positioned adjacent to each other. These end support members of each set can then be releasably fixed to each other, for example, by a magnetic catch or other suitable means, to thereby hold the support apparatus in the open position. To move the support apparatus to the retracted position, the releasably fixing means is released and each set of inner members and associated support members moved to the retracted position.

The present invention also encompasses an awning or the like including a support apparatus as described herein. The awning or the like may include one support apparatus, or a plurality of support apparatus. It will be appreciated that the plurality of support apparatus may each comprise a set of inner members and associated support members.

BRIEF DESCRIPTION OF THE ACCOMPANYING DRAWINGS

DETAILED DESCRIPTION OF PREFERRED EMBODIMENTS OF THE INVENTION

Figure 1:
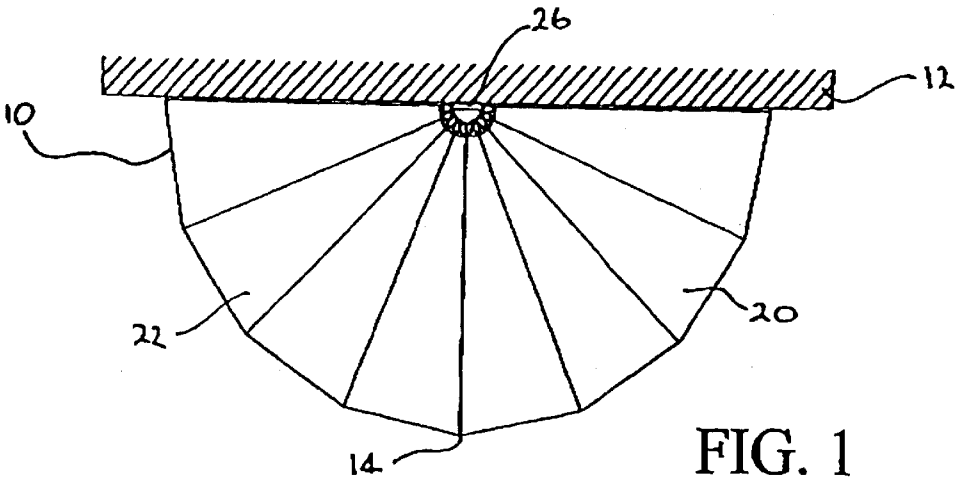
FIG. 1 is a plan view of an awning embodied by the present invention.
Figure 2:
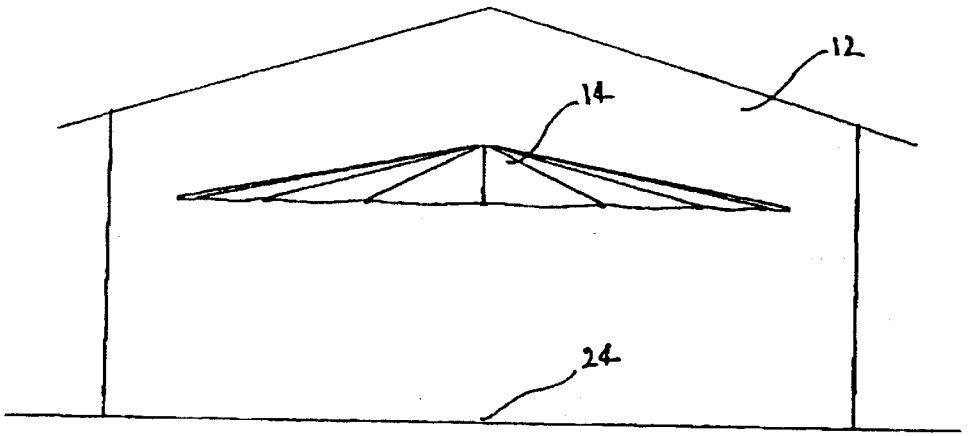
FIG. 2 is a front view of the awning of FIG. 1.
Figure 3:
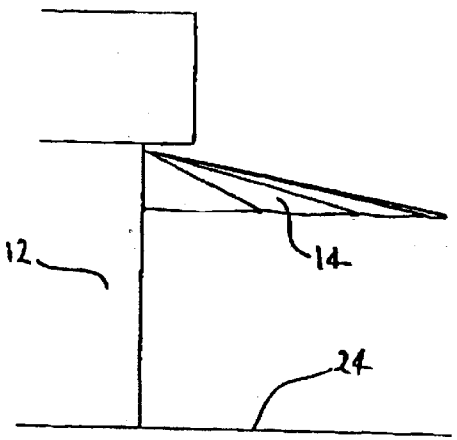
FIG. 3 is a side view of the awning of FIG. 2.

The awning 10 shown in FIG. 1 is secured to a support surface in the form of a side wall of a shed or other building 12. The awning has a covering 14, for example, made of a sun shade material or of a canvas or tarpaulin material that is supported by a support structure that includes a plurality of support members 16. The covering 14 consists of a first cover 20 and a second cover 22 which meet each other so as to provide a continuous shaded region 24 underneath the awning 10, as best shown in FIG. 2. A side view of the awning is illustrated in FIG. 3.

Figure 4:
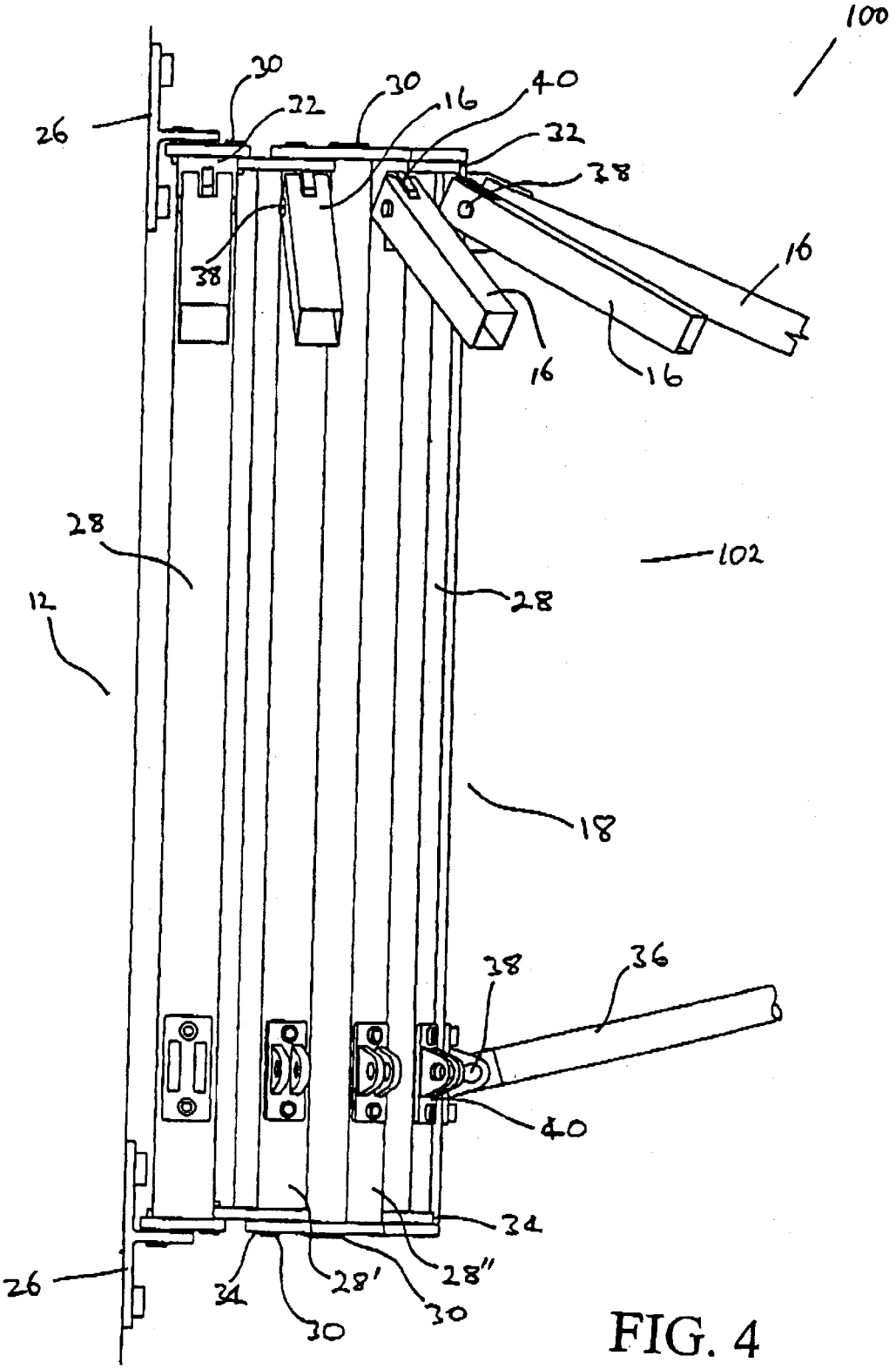
FIG. 4 is a side view of the support apparatus of the awning shown in FIG. 3.
Figure 5:
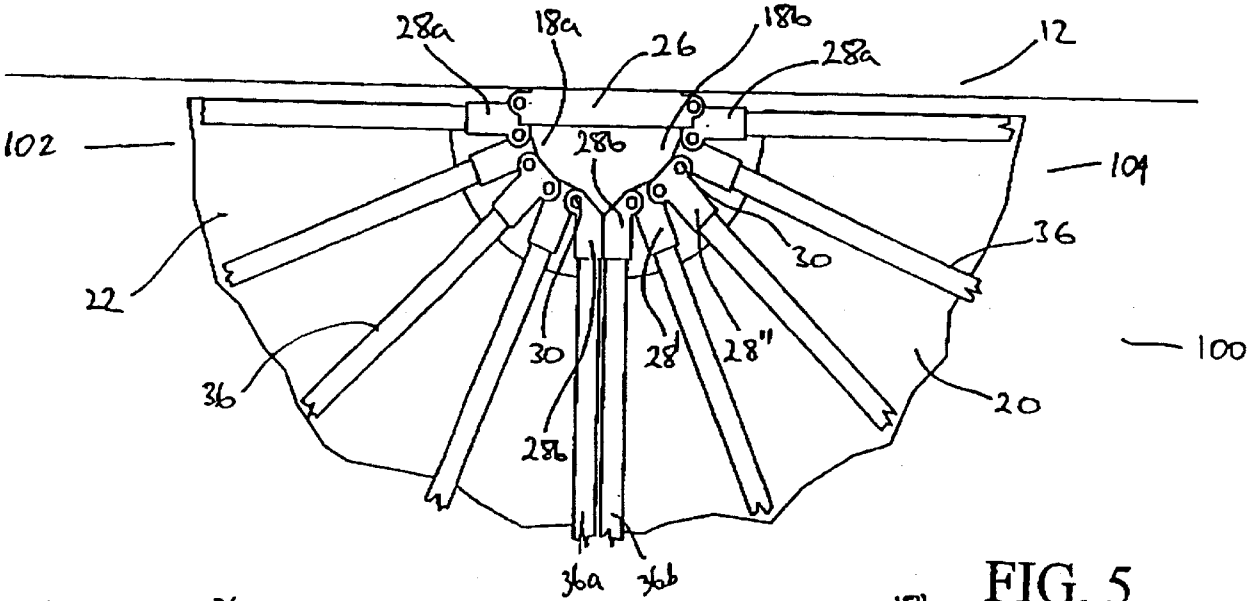
FIG. 5 is a bottom view of the support apparatus of FIG. 4 showing the orientation of inner members when the support members are spaced apart from each other.
Figure 6:
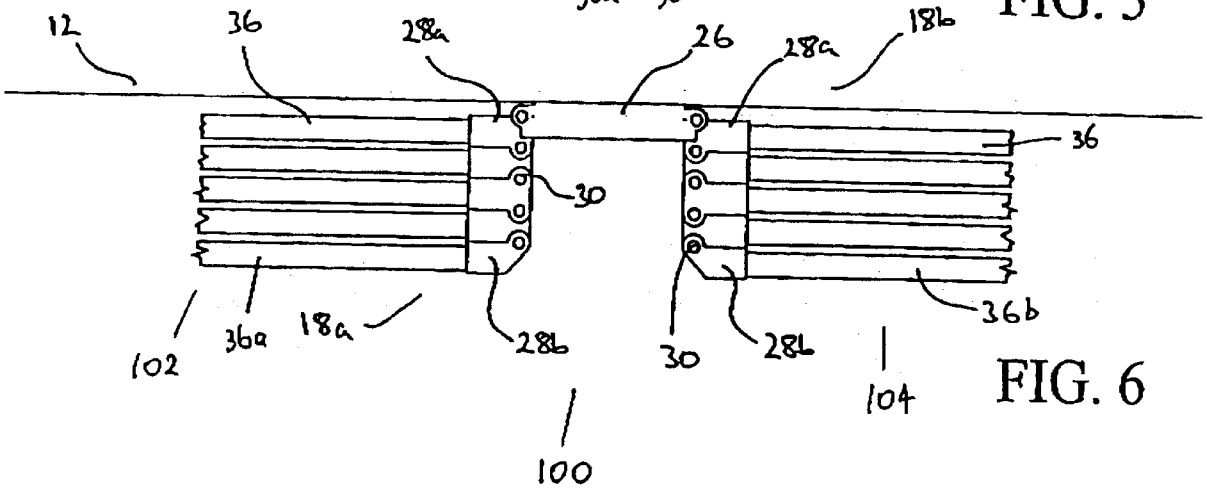
FIG. 6 is a bottom view of the support apparatus of FIG. 5 showing the orientation of inner members when the support members are positioned close together.

Turning now to considers FIGS. 4, 5 and 6, the support apparatus 100 comprises a plurality of inner members 28, each having a generally outwardly extending support member 16 affixed thereto. As best shown in FIGS. 5 and 6, the support apparatus 100 comprises two sets of inner members 102, 104. The set of inner members 102 is shown in FIG. 4. This set of inner members 102 comprises a plurality of inner members 28. Each inner member 28 comprises a generally vertically extending member. The inner member 28 that is located at the end of set 102 located adjacent wall 12 is affixed via brackets 26 to the wall 12.

In the set of inner members 102, each inner member is pivotally connected to the immediately adjacent inner members by pivot pins 30. This allows each of the inner members 28 to be pivoted relative to the immediately adjacent pivot member.

Figure 8:
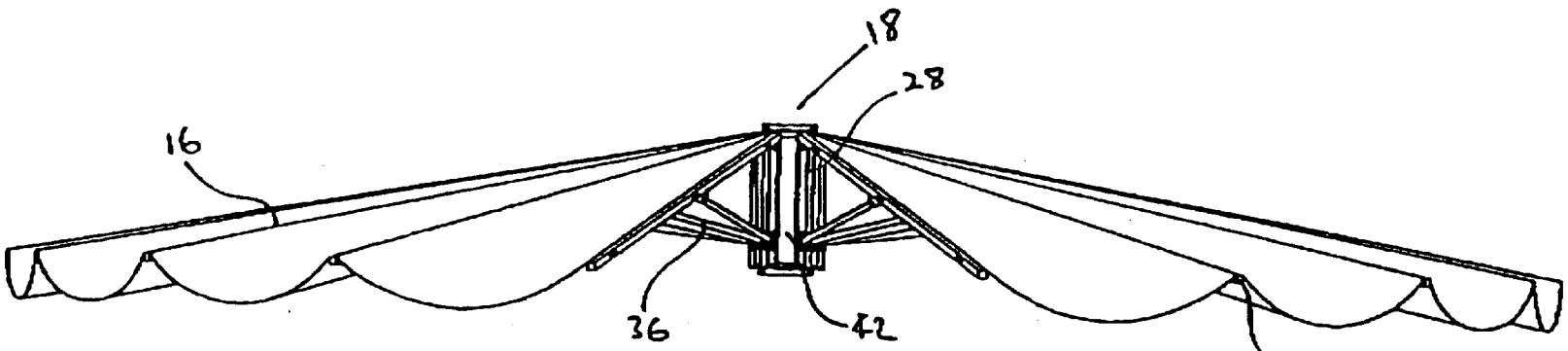
FIG. 8 is a front view of the awning of FIG. 7 as the support members are being spaced apart from each other.
Figure 7:
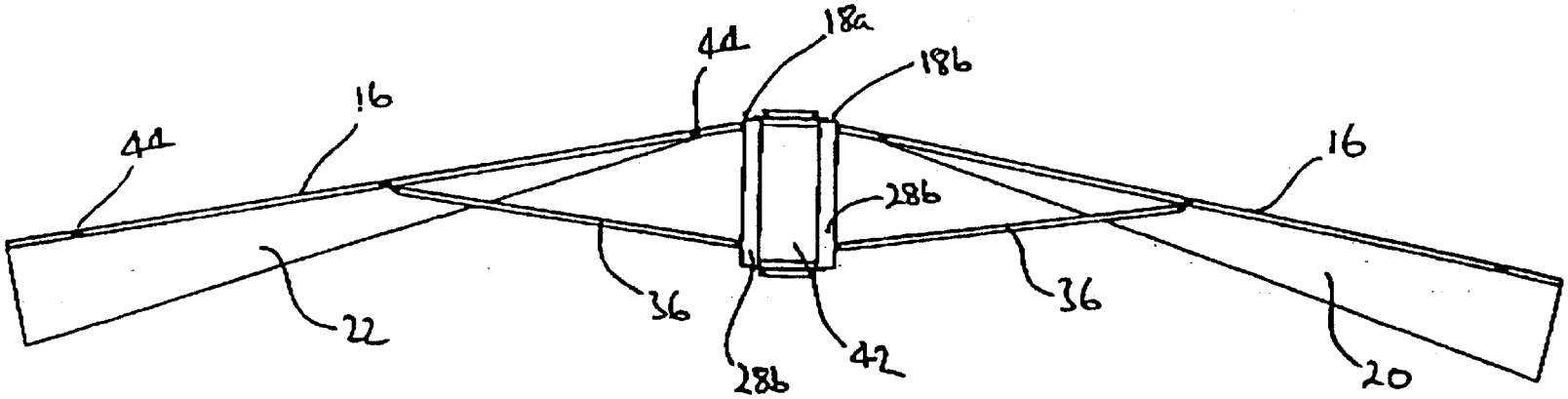
FIG. 7 is a front view of the awning of FIG. 1 when the support members are positioned close together.

Braces 36 are pivotally attached to lower parts of each of the inner members 28 to assist in bracing and strengthening support members 16. Each brace 36 is connected at one end to its associated inner member and at the other end to its associated support member. This is best shown in FIGS. 7 and 8. Each respective support member 16 and brace 36 pair is pivotally secured to the corresponding inner member and is able to pivot through limited distances in the longitudinal direction of the hub arrangement about pivot pins 38 carried by brackets 40.

As mentioned above, the awning 10 shown in FIGS. 4 to 6 comprises a first set of inner members 102 that are each pivotally connected together and a second set of inner members 104 that are each pivotally connected together. When sets 102, 104 are placed in a retracted position, the inner members are positioned such that the support members 36 of each respective set 102, 104 lie substantially adjacent to each other. Therefore, in the retracted position, the awning occupies only a very small amount of room and the awning can be stowed in the retracted position such that it is relatively unobtrusive. This is best shown in FIG. 6. In the embodiment of FIG. 6, when the respective sets of inner members 102, 104 are placed in the retracted position, the inner members 28 of each set are in substantially linear alignment.

In order to move the apparatus from the retracted position shown in FIG. 6 to the open position as shown in FIG. 5, the outer most support members 36*a*, 36*b* of respective sets 102, 104, are moved so as to cause rotation of the inner members about respective pivot points 30. This results in the inner members 28 adopting a generally arcuate alignment, as is best shown from the plan view in FIG. 5. When outer most support members 36*a*, 36*b* are positioned such that they are substantially adjacent to each other, or indeed in abutment with each other, affixing means, such as a magnetic catch located on support means 36*a*, 36*b* releasably secures support means 36*a* and 36*b* together. This then holds the awning in the open position.

In order to facilitate opening of the awning, a suitable rope and pulley arrangement may be provided such that pulling on the rope when the awning in the retracted position shown in FIG. 6 causes the awning to move to the open position shown in FIG. 5. In order to move the awning from the open position to the retracted position, it may be possible to pull on the rope to thereby open the magnetic catch and cause the awning to move to the retracted position. Other arrangements may also be used. The person of skill in the art will appreciate and readily understand that a number of suitable arrangements may be provided for the purpose of opening and retracting the awning. It may also be possible to use an electric motor to open and close the awning. Remote control means may also be provided to control the motor.

The embodiments shown in FIGS. 1 to 8 may also be described using the terms included in the description of the third aspect of the present invention. The description is as follows:

The awning 10 shown in FIG. 1 is secured to a support surface in the form of a side wall of a shed 12 and has a covering 14 that is supported by a support structure comprising a plurality of support members in the form of struts 16 extending radially from a centrally located hub arrangement 18. The covering 14 is formed from canvass and consists of a first cover 20 and a second cover 22 which meet each other so as to thereby provide a continuous shaded region 24 underneath the awning 10 as indicated in FIG. 2. A side view of the awning is illustrated in FIG. 3.

The hub arrangement 18 is secured to the side wall of the shed 12 through brackets 26 and incorporates a plurality of hub members 28 arranged consecutively alongside each other. Immediately adjacent hub members such as indicated by 28' and 28" are pivotally connected to each other and are able to be pivoted relative to one another about pivot pins 30 arranged at opposite ends 32 and 34 of the hub members.

Braces 36 projecting from the lower end region of the hub members support struts 16. Each respective strut 16 and brace 36 pair is pivotally secured to the corresponding hub member and is able to pivot limited distances in the longitudinal direction of the hub arrangement about pivot pins 38 carried by brackets 40.

The hub arrangement is illustrated further in FIG. 4. As can be seen, the hub arrangement consists of separate hubs 18*a* and 18*b*, the innermost hub members 28*a* of each hub being linked together by brackets 26. The outermost hub members 28*b* of each hub are held alongside one another to thereby maintain the covers 20 and 22 in an unfolded condition by means as will be described below.

FIG. 5 shows the orientation of hub members 28 when the struts 16 are spaced apart from each other around their hubs such that the covers 20 and 22 of the awning are fully unfolded. The orientation of the hub members when the struts are nested together and so in retracted positions such that the covers are thereby folded is shown in FIG. 6.

In order to unfold the covers 20 and 22, the outermost struts 16 of each hub 18*a* and 18*b* are drawn toward each other. This causes rotational movement of the hub members 28 of each hub such that gap 42 between the hubs is progressively narrowed and is ultimately closed as indicated in FIG. 7 and FIG. 8. More particularly, adjacent hub members are caused to pivot relative to one another about corresponding pivot pins 30. This results in hub members being swung about a common axis of each respective hub in a generally arcuate direction as shown.

The innermost hub member of each hub is inhibited against rotation relative to bracket 26 to thereby hold the struts they support alongside the side wall of shed 12 and so provide a substantially fixed origin from which the cover of each shelter is able to be unfolded in use.

As can be seen, rare earth magnets 44 are arranged apart from each other along the outermost strut 16 of one of the support structures for holding that strut to the same strut of the other support structure and so maintain the covers in an unfolded condition. The strength of the magnets is determined such that the outermost struts will part should an ambient breeze exceed a nominal strength. When parted in such instances, the struts 16 of each support structure tend to inherently swing about their respective hubs under their own weight and so return to their retracted positions as indicated in FIG. 6 thereby reducing the possibility of damage being caused to the awning 10.

In a preferred embodiment, the awning may be provided with a manually operable release mechanism arranged to facilitate the retraction of the awnings support structures. Generally, such a mechanism will include a cord which when pulled causes the magnets hold to release and thereby allow the struts 16 of each support structure to be swung to their respective retracted positions.

Moreover, it is not necessary that the hub arrangement 18 of an awning of the invention comprise a pair of hubs 18*a* and 18*b* as described above indeed, and awning may only have a single hub. Such an awning may be provided for location in the corner of a courtyard or the like. In this instance, the awning will be fixed to a single wall and be swingable about the hub such that the outermost strut 16 can be secured in position alongside an adjacent wall to thereby maintain the cover in an unfolded condition. Again, rare earth magnets may be permanently located on the adjacent wall to maintain the cover in an unfolded condition when in use. Alternatively, other fixing mechanisms may be used.

The apparatus may be fixed to any fixed structure, such as a wall or a pole. If the apparatus is fixed to a freestanding pole, the apparatus may, in the extended position, extend substantially around the pole.

The apparatus of the present invention provides an aesthetically pleasing awning structure or the like that can cover quite large areas when in the open position. The present invention allows the awning or the like to be a modular system, which provides great flexibility in installing the awning. The apparatus can be removed to the retracted position and stowed such that it occupies very little space and stows neatly and unobtrusively.

Those skilled in the art will appreciate that the present invention may be subject of variations and modifications other than those specifically described. It is to be understood that the present invention encompasses all such variations and modifications that fall within its spirit and scope.

What is claimed is:

1. A support apparatus comprising a plurality of inner members, said plurality of inner members including a plurality of generally vertically extending members, each inner member being pivotally connected to an adjacent inner member in an articulated relationship so as to provide a series of moveable pivot points, a plurality of support members extending outwardly from the generally vertically extending members and a plurality of braces, each brace extending from a generally vertically extending member to a support member associated with the generally vertically extending member wherein said pivot points are moveable between an extended position in which said support members are spaced away from each other and a retracted position such that said support members lie substantially adjacent to each other.

2. A support apparatus as claimed in claim 1 wherein the support members are connected to their respective generally vertically extending members.

3. A support apparatus as claimed in claim 1 wherein the braces are connected to their respective generally vertically extending member and support member.

4. An apparatus as claimed in claim 1 wherein the support members extend from an upper part of the generally vertically extending members and the braces extend from a lower part of the generally vertically extending members.

5. An awning comprising a support structure as claimed in claim 1 and a covering material supported by the support members.

6. A support apparatus comprising a plurality of inner members, said plurality of inner members including a plurality of generally vertically extending members, each inner member being pivotally connected to an adjacent inner member in an articulated relationship so as to provide a series of moveable pivot points, a plurality of support members pivotally connected to their respective generally vertically extending members and extending outwardly from the generally vertically extending members, and a plurality of braces, each brace extending from a generally vertically extending member to a support member associated with the generally vertically extending member, wherein said pivot points are moveable between an extended position in which said support members are spaced away from each other and a retracted position such that said support members lie substantially adjacent to each other.

7. A support apparatus comprising a plurality of inner members, said plurality of inner members including a plurality of generally vertically extending members, each inner member being pivotally connected to an adjacent inner member in an articulated relationship so as to provide a series of moveable pivot points, a plurality of support members extending outwardly from the generally vertically extending members and a plurality of braces, each brace extending from a generally vertically extending member to a support member associated with the generally vertically extending member, each brace in which pivotally connected to their respective generally vertically extending member and support member, wherein said pivot points are moveable between an extended position in which said support members are spaced away from each other and a retracted position such that said support members lie substantially adjacent to each other.

8. A support apparatus comprising two sets of inner members, each set having a plurality of inner members, said plurality of inner members including a plurality of generally vertically extending members, each of the inner members in a set being pivotally connected to adjacent inner members of that set, each set of inner members being connected to a stationary structure, a plurality of support members extending outwardly from the generally vertically extending members and a plurality of braces, each brace extending from a generally vertically extending member to a support member associated with the generally vertically extending member wherein in the open position, each set of inner members extends such that the end inner member of one set that is located away from a fixed end inner member of that set becomes positioned either adjacent to or in abutment with the corresponding inner member of the other set such that the respective support members associated with the end inner members of each set are either in abutment with each other or are positioned adjacent to each other, the apparatus further comprising releasable fixing means to releasably fix the respective end inner members or end support members of each set to each other to thereby hold the support apparatus in the open position.

9. An apparatus as claimed in claim 8 wherein the releasable fixing means comprises a magnetic catch.

10. A support structure as claimed in claim 8 wherein each inner member of a set is pivotally connected to an adjacent inner member in an articulated relationship so as to provide a series of moveable pivot points.

11. A support apparatus comprising a first set of inner members, each of the inner members being pivotally connected to adjacent inner members of the first set, a second set of inner members, each of the inner members of the second set being pivotally connected to adjacent inner members of the second set, support members extending outwardly from the inner members of the first set, support members extending outwardly from the inner members of the second set, each set of inner members being connected to a stationary structure, each set of inner members being movable from an open position in which the plurality of inner members are in generally arcuate alignment to a retracted position in which the inner members are in generally linear alignment, wherein in the open position each set of inner members extends such that an end inner member of one set becomes positioned adjacent to or in abutment with a corresponding inner member of the other set such that the respective support members associated with the end inner members of each set are in abutment with each other or are positioned adjacent to each other, the apparatus further comprising releasable fixing means to join the respective end inner members or end support members of each set to each other to thereby hold the support apparatus in the open position.

12. An apparatus as claimed in claim 11 wherein the releasable fixing means comprises a magnetic catch.

13. A support apparatus as claimed in claim 11 wherein each set of inner members includes a plurality of generally vertically extending members and the plurality of support members extend outwardly from the generally vertically extending members.

14. A support apparatus as claimed in claim 13 further comprising a plurality of braces, each brace extending from a generally vertically extending member to a support member associated with the generally extending support member.

15. A support apparatus as claimed in claim 14 wherein the support members are connected to their respective generally vertically extending members.

16. A support apparatus as claimed in claim 15 wherein the support members are pivotally connected to their respective generally vertically extending members.

17. An apparatus as claimed in claim 15 wherein the braces are pivotally connected to their respective generally vertically extending members.

18. A support apparatus comprising a plurality of inner members, said plurality of inner members including a plurality of generally vertically extending members, each inner member being pivotally connected to an adjacent inner member in an articulated relationship so as to provide a series of moveable pivot points, a plurality of support members connected to respective of the generally vertically extending members and extending outwardly from the generally vertically extending members wherein each generally vertically extending member is pivotally connected to an adjacent generally vertically extending member by pivot connections located at an upper end and a lower end of the generally vertically extending member, and wherein said pivot points are moveable between an extended position in which said support members are spaced away from each other and a retracted position such that said support members lie substantially adjacent to each other.

19. A support apparatus as claimed in claim 18 wherein said pivot connections are located transversely of a longitudinal axis of the support member connected to the generally vertically extending member.

20. A support member as claimed in claim 19 further including a plurality of braces, each brace extending from a generally vertically extending member to a support member associated with the generally vertically extending member.

* * * * *